United States Patent [19]

Galmiche et al.

[11] 4,090,659

[45] May 23, 1978

[54] INSULATED CONTAINER FOR THE STORAGE AND TRANSPORTATION OF MERCHANDISE

[75] Inventors: Jacques Galmiche, Sully sur Loire; Robert Blasco, Saint Jean de Braye, both of France

[73] Assignee: Etablissements Larousse, Tigy, France

[21] Appl. No.: 719,849

[22] Filed: Sep. 2, 1976

[30] Foreign Application Priority Data

Jun. 15, 1976 France ..... 76 18102

[51] Int. Cl.[2] ..... B65D 5/22; B65D 5/56

[52] U.S. Cl. ..... 206/410; 229/41 B; 206/386; 217/43 A; 108/51.3

[58] Field of Search ..... 229/14 R, 14 H, 14 C, 229/41 R, 41 B; 206/386, 523, 600; 217/43 A; 108/51.3, 56.2

[56] References Cited

U.S. PATENT DOCUMENTS

| | | | |
|---|---|---|---|
| 1,691,178 | 11/1928 | Beaman | 229/14 H |
| 1,747,980 | 2/1930 | Kondalf | 229/41 R X |
| 2,790,544 | 4/1957 | Whiton | 206/386 X |
| 3,236,206 | 2/1966 | Willinger | 229/14 H |
| 3,949,874 | 4/1976 | Heavner | 206/600 X |

FOREIGN PATENT DOCUMENTS

| | | | |
|---|---|---|---|
| 944,735 | 4/1974 | Canada | 217/43 A |
| 1,392,905 | 2/1965 | France | 229/14 H |
| 1,467,991 | 12/1966 | France | 229/14 H |

*Primary Examiner*—Herbert F. Ross
*Attorney, Agent, or Firm*—Young & Thompson

[57] ABSTRACT

A container for storing or transporting delicate or perishable merchandise consists of a box having two end elements and two faces and seated on a handling base such as a pallet. The box is formed by two panels each having a central portion constituting one face, the central portion being placed between two side flaps each forming part of one of the end elements, the interior of the box being lined with insulating material. The flaps can be folded back against the central portion which can in turn be folded back against the base, locking means being provided for maintaining insulating plates in position when the box is erected.

4 Claims, 5 Drawing Figures

INSULATED CONTAINER FOR THE STORAGE AND TRANSPORTATION OF MERCHANDISE

This invention relates to an insulated container for the storage and transportation of merchandise and especially for the isothermal transportation of perishable foods or for the transportation of fragile materials which have to be protected against impacts.

Containers are already known which consist of a non-deformable box of wood or of metal rigidly fixed to a pallet and provided with an insulating lining. These devices suffer from a disadvantage in that they are as cumbersome when empty as when they are full, thus appreciably increasing utilization requirements and especially complicating their return in the empty state prior to re-use.

Moreover, containers of this type are of substantial weight and this constitues a disadvantage especially when they are employed for road or air transportation.

Palletized containers are also known in which the box is made of cardboard and comprises two elements each constituted by one face and two half-ends, the half-ends being fastened in pairs to the central portion of the short sides. Containers of this type can be provided with an internal lining but cannot be disassembled and are therefore subject to the same disadvantage of overall size when empty as the containers mentioned in the foregoing.

Finally, there was disclosed in French Pat. application No. 75 21366 of 8th July, 1975 in the name of the present Applicant a folding container comprising on the one hand a seating pallet on which are fixed four separate side panels so designed as to be capable of folding back against the pallet and, on the other hand, detachable locking means for maintaining the panels in their erect position.

This container is well suited to handling and transportation of products which do not call for insulation. On the other hand it does have a disadvantage in that it cannot be provided with an insulating lining without losing its folding character.

The present invention is directed to the construction of an insulated container which is not subject to the above-mentioned drawbacks, which can be folded back when empty, which has a low dead weight and which can be erected with ease.

The insulated container in accordance with the invention comprises a handling base such as a pallet which serves as a seating for a box having two ends and two faces, said box being formed by two panels each having a central portion constituting one face and located between two side flaps carried by said face and each forming part of one of the ends, the interior of said box being lined with insulating material. The container is distinguished by the fact that the flaps can be folded back against the central portions which carry them, said central portions being in turn capable of being folded back against the base, and by the fact that the container is provided with locking means for maintaining added insulating plates in position when the box is erected.

The container which is thus obtained is perfectly insulated when it is mounted in the erect position by means of the insulating plates which are engaged within the locking means. Furthermore, the insulating plates are detachable and can therefore be withdrawn, thereby releasing the panels which constitute the peripheral band. In consequence, the panels can be folded back against the seating and the bulk of the container can thus be considerably reduced at the time of transportation in the empty state.

Perferably, the insulating plates are fabricated either from expanded polystyrene (or like heat-insulating material of the cellular type) when heat insulation is desired or from shockproof agglomerate when it is desired to obtain protection against impacts.

In accordance with a preferred mode of construction, each end element is provided with an insulating end plate which is inserted in the erect position in at least one strap formed in at least one of the flaps considered. Each face can then be provided with an insulating faceplate engaged at each end between the lateral edge of the face and the exterior of the strap which forms part of the adjacent end element. The box can comprise a lid fitted with an insulating plate and capable of covering on the one hand the peripheral band of the box in the upright position and on the other hand the entire seating unit, the panels and the dismantled insulating plates in the folded-back position.

When the box is erected, its peripheral band and its opening are completely covered with insulating material and this latter is perfectly maintained. Furthermore, the lid ensures protection of the complete assembly in the folded-back position.

In accordance with a first embodiment of the invention, the two flaps corresponding to a given end element overlap in the erect position, the strap being arranged within the flap which is located on the outside and engaged in an open window in the other flap so as to ensure that the insulating plate which is inserted in the strap ensures interlocking of the two flaps. It is accordingly possible to make use of a plastic material which is similar to the corrugated cardboard of the type designated by the trade name AKYLUX.

In accordance with a second embodiment, the two flaps corresponding to a given end element each have a strap, and a common insulating plate is accordingly engaged in the two straps of the same end element when the box is in the erect position: this also ensures excellent locking of the two flaps which form part of the same end element and permits the use of corrugated cardboard.

Further characteristic features and advantages of the invention will become apparent from the description which now follows, two particular embodiments of the invention being illustrated in the accompanying drawings which are given by way of non-limitative example, and in which.

Figure 1:
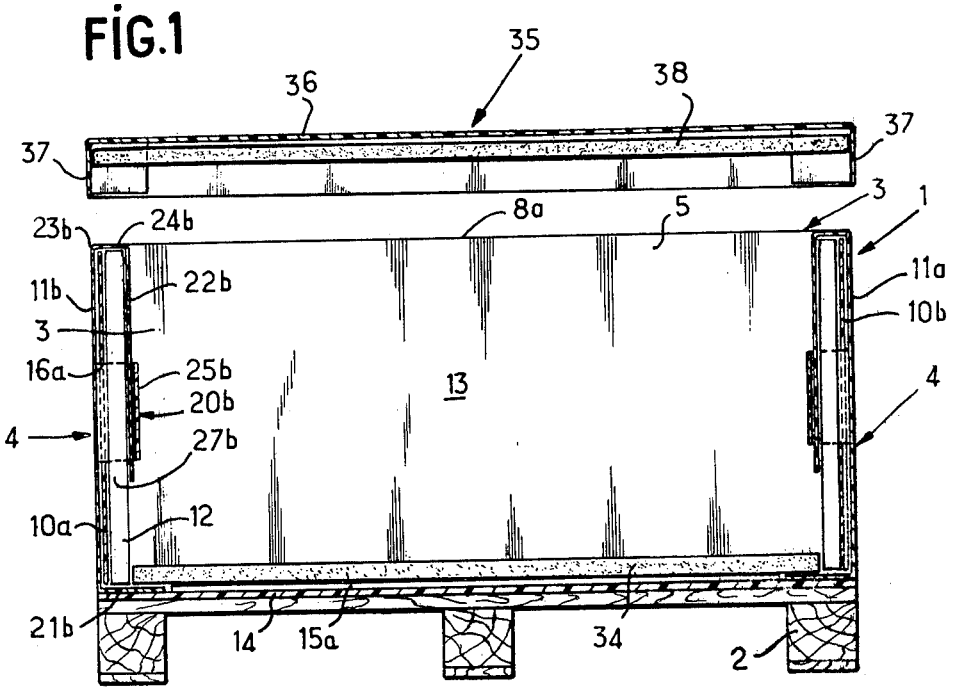
FIG. 1 is a sectional view in elevation taken along line I—I of FIG. 2 and showing a first embodiment of the invention in the erect position.

There is illustrated in FIGS. 1 to 5 a container 1 comprising a handling base constituted by a pallet 2. When in service at the time of storage and transportation of merchandise, said pallet 2 is placed at the bottom and serves as a seating for a parallelepipedal box 3 having two end elements 4 and two faces 5 which form in pairs the opposite vertical sides of the box 3 when the pallet 2 is horizontal.

The box 3 is made up of two substantially identical and opposite panels 8*a* and 8*b* which are articulated on the pallet 2 and can be folded back against this latter. Each panel has a central portion 9*a* or 9*b* which carries two inner side flaps 10*a* and 10*b* and outer side flaps 11*a* and 11*b* located on each side of said central portion and capable of being folded back against this latter.

The two central portions 9*a* and 9*b* can in turn be folded-back against the pallet 2. They form the faces 5 of the box 3 when this latter is mounted whilst each end element 4 accordingly comprises a flap 10*a* or 10*b* and a flap 11*b* or 11*a* which are applied against each other and form part of the panel 8*a* in one case and the panel 8*b* in the other case.

Again in the erect position, it should further be noted that insulating end-plates 12 and face-plates 13 are maintained by locking means against the internal walls of the box 3 so as to form an insulating lining within the interior of this latter.

The insulating plates 12 and 13 can be formed of expanded polystyrene or of shockproof agglomerate.

Figure 2:
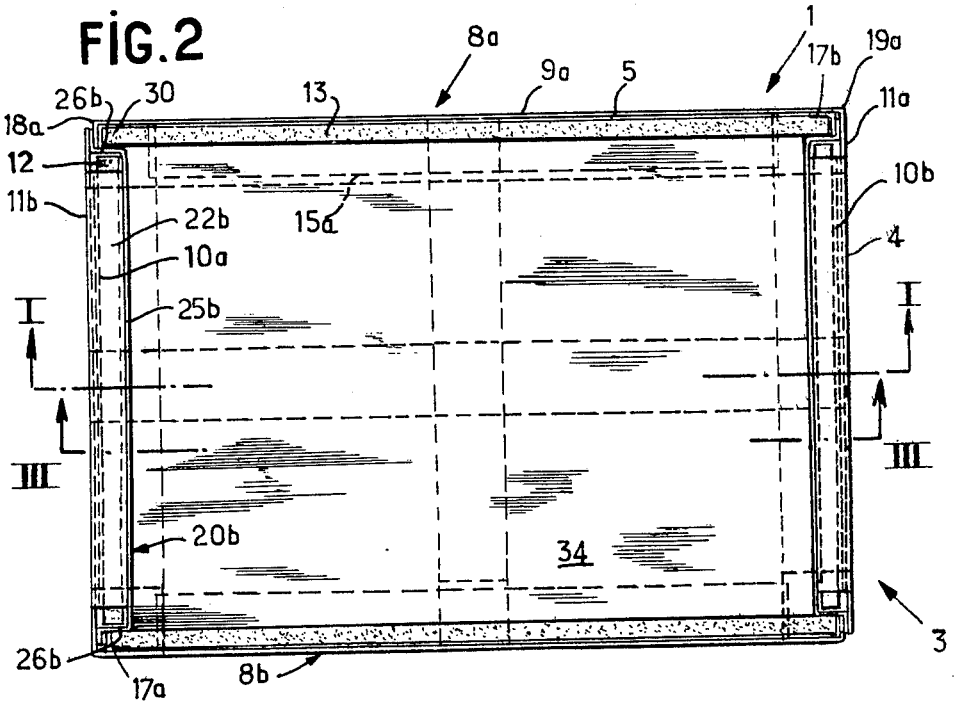
FIG. 2 is a top view in which the lid has been removed and shows the embodiment of FIG. 1, also in the erect position.
Figure 5:
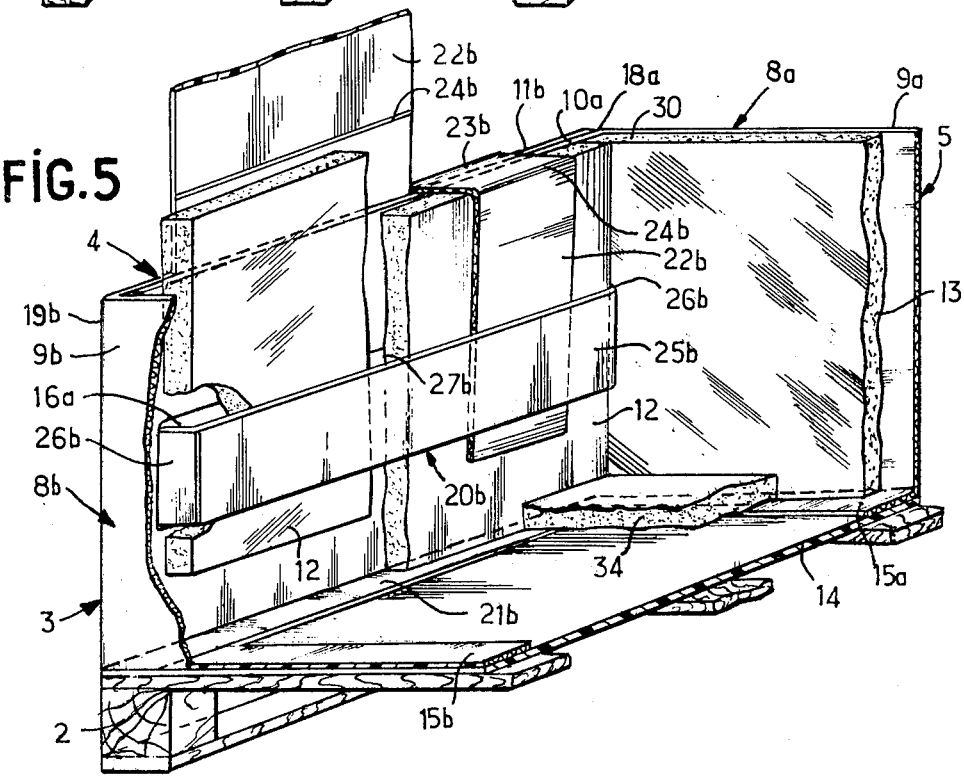
FIG. 5 is a cutaway view in perspective of the embodiment illustrated in the previous figures, in which there is shown the engagement of the different insulating plates; for reasons of clarity, the plates shown are of greater thickness than in FIGS. 1, 2 and 4 and the insulating end-plate has been divided into two portions shown at two different stages of positioning of these latter.

The structure of the panel 8*a* which is substantially identical with that of the panel 8*b* will now be described in detail. For the sake of enhanced clarity, reference will be made to the relative positions of the different elements and to their directions in the case in which the box 3 is mounted and the pallet 2 is horizontal as illustrated in FIGS. 1, 2 and 5.

The panel 8*a* is joined to the pallet 2 along one of the long sides of this latter by means of a lower edge of its central portion 9*a* having an extension in the form of an articulated tab 15*a* secured to a continuous base element 14 by stapling, for example, said base element being rigidly fixed to the pallet 2 which is covered by this latter.

The inner flap 10*a* of the panel 8*a* is articulated along one vertical edge 18*a* of the central portion 9*a* and has a rectangular window 16*a* which is elongated in the horizontal direction and placed at mid-height. A folding tongue 17*a* serves to extend the edge of the flap 10*a* which is opposite to the edge 18*a*.

The outer flap is articulated on the central portion 9*a* along one edge 19*a* of this latter which is opposite to the edge 18*a*. Said flap is provided with a strap 20*a*, a folding bottom flap 21*a* and a folding top flap 22*a* having two horizontal articulation lines 23*a* and 24*a* spaced at a distance corresponding to the thickness of the insulating end-plates 12*a*.

The strap 20*a* is placed on that side of the flap 11*a* which is located within the interior of the box 3 and essentially comprises a strip 25*a* supported by two vertical end portions 26*a* which form with the flap 11*a* a flattened rectangular vertical passage 27*a* for the engagement of an insulating end-plate 12*a*.

The strip 25*a* is located at the level of the window 16*a* of the flap 10*a*, the dimensions of which are slightly larger than those of said strip whilst the distance between the end portions 26*a* is substantially the same as the internal width of the box 3 fitted with insulating face-plates 13.

In a preferred embodiment, the panels 8*a* and 8*b* are formed of a plastic material similar to the double-face corrugated cardboard of the type designated by the trade name Akylux, the various articulation lines being formed by grooving.

The assembly shown in detail in FIG. 5 will now be described in the case of one corner of the box 3, of the panels 8*a* and 8*b* and of the plates 12 and 13 at the level of an end element 4 of the erected box 3. The elements of the panel 8*b* which bear the same reference numerals as the corresponding elements of the panel 8*a* are followed by the index *b* instead of the index *a*.

The inner flap 10*a* and the outer flap 11*b* are applied against each other, the flap 11*b* being located on the outside. The strap 20*b* which passes through the window 16*a* projects towards the interior of the box 3 with respect to the flap 10*a* and the insulating plate 12 is inserted into the passage 27*b* which has thus been freed, with the result that the flaps 10*a* and 11*b* are interlocked.

The top portion of the plate 12 is covered by the flap 22*b* which is folded at an angle of 90° along each of the lines 23*b* and 24*b* and the extremity of which is engaged in the strap 20*b*. The plate 12 which is thus displaced in the downward direction applies the bottom flap 21*b* against the base element 14, this latter being folded at an angle of 90° with respect to the flap 11*b* and passed beneath the flap 10*a*. The tongue 17*a* is applied against the portion 9*b*.

The two insulating face-plates 13 are placed in contact with the central portions 9*a* and 9*b* which are entirely covered in such a manner as to be inserted along their vertical edges 30 between the end portions 26*a* or 26*b* of the straps 20*a* and 20*b* under consideration and the central portions 9*a* and 9*b* which are covered by said plates as shown in FIG. 5 in the case of the central portion 9*a* and one of the end portions 26*b*.

An insulating base-plate 34 is placed on the base element 14, the edges of said plate being thus in contact with the plates 12 and 13.

Figure 3:
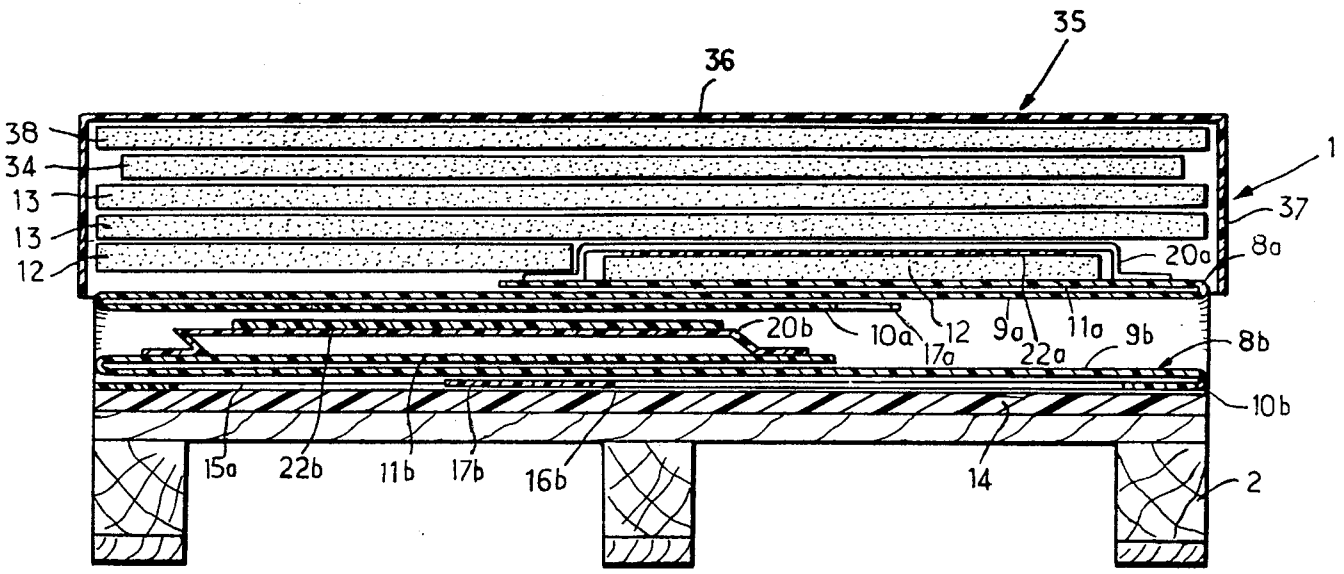
FIG. 3 is a sectional view in elevation taken along line III—III of FIG. 2 and showing the container of FIG. 1 and of FIG. 2 in the folded-back position, in which the thickness of the insulating plates has been increased for reasons of clarity with respect to the thickness shown in FIGS. 1 and 2.

The box 3 also has a lid 35 shown in FIGS. 1 and 3 and constituted by a covering element 36 provided with flanges 37 and adapted to carry an insulating lid-plate 38. The lid 35 is adapted to fit over the box 3 when this latter is mounted in position and over the entire container 1 when the box 3 is in the folded condition.

Preferably, the material employed for the covering element 36 and the plate 38 is the same as those employed respectively for the panels 8*a* and 8*b* and the plates 12, 13 and 34.

When the box 3 is mounted in the position which has just been described, the container 1 can readily be transported and handled by means of the pallet 2.

The insulating plates 12, 13, 34 and 38 form a complete covering for the internal surface of the box 3 and insulate this latter in an effective manner. The products placed within the container 1 are therefore wholly protected either against external heat when the plates 12, 13, 34 and 38 are of expanded polystyrene or against impacts when the plates 12, 13, 34 and 38 are of shock-proof agglomerate and it is possible to employ the container 1 for transportation of delicate or perishable materials.

Furthermore, the position-maintenance of the insulating plates 12, 13 is ensured in a positive manner, each plate 12 being maintained both by a strap 20*a* (or 20*b*) and a flap 22*a* (or 22*b*) whilst each plate 13 is clamped along its edges 30 between an end portion 26*a* or 26*b* and a face 9*a* or 9*b*.

Finally, the engagement of the plates 12 in the straps 20*a* and 20*b* which involves a light clamping action has the effect of fastening the flaps 10*a*, 10*b*, 11*a* and 11*b* together in pairs in a perfect manner and thus ensuring the position-maintenance of the panels 8*a* and 8*b*.

The flaps 11*a* and 11*b* cannot be caused to gape outwards by the flaps 21*a* and 21*b* and the flaps 22*a* and 22*b*, thus avoiding any risk of catching and tearing at the time of transportation.

In order to fold-back the box 3, the initial operation consists in disengaging the flaps 22*a* and 22*b* from the straps 20*a* and 20*b*, then in withdrawing the plates 12 by sliding these latter upwards within the straps 20*a* and 20*b* as shown in FIG. 5 in the case of the plate 12 which is located in front. The plates 13 are then freed by sliding these latter upwards between the end portions 26*a* and 26*b* and the corresponding central portion 9*a* or 9*b*. The insulating base-plate 34 can then be readily withdrawn from the bottom of the box 3.

The flaps 10*a*, 10*b*, 11*a* and 11*b* being thus released as a result of withdrawal of the plates 12, it is then possible to displace said flaps outwards in pivotal motion, each with respect to the corresponding central portion 9*a* or 9*b*, thus disengaging the straps 20*a* and 20*b* from the windows 16*b* and 16*a*.

Figure 4:
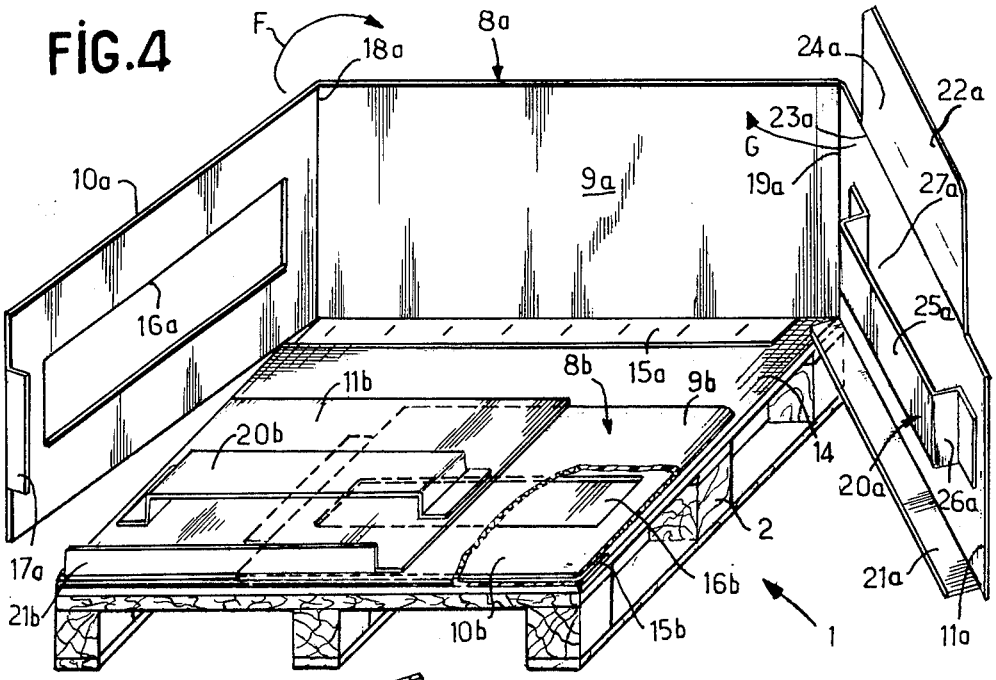
FIG. 4 is a partially cutaway view in perspective showing the container of the previous figures, the insulating plates and the lid having beem omitted from this figure, one of the panels being completely folded-back and the other panel being partially erected.

The flaps 10*a* and 10*b* are then folded-back inwards against the face 9*a* or 9*b* of the corresponding panel 8*a* or 8*b* in the direction of the arrows F (as shown in FIG. 4) whilst the flaps 11*a* and 11*b* are folded-back outwards with respect to the corresponding central portions 9*a* and 9*b* by displacing them in pivotal motion in the direction of the arrow G of FIG. 4. The panel 8*b* is then folded-back against the base element 14 and placed in the position shown in FIG. 4, whereupon the panel 8*a* is folded-back onto said panel 8*b*.

The panels 8*a* and 8*b* are then placed in the position shown in cross-section in FIG. 3, the strap 20*b* being deformed in order to reduce the overall height.

One of the plates 12 is then inserted into the strap 20*a* which can be reached from above and the other plate 12 is placed next to the strap 20. The two insulating plates 13 followed by the plates 34 and 38 are then placed successively on the assembly thus obtained, the lid 35 being finally placed over the unit as a whole.

The height of the container 1 is thus reduced to only a small value after the folding operation has thus been completed. This makes it possible to minimize costs of transportation and storage of empty containers 1 and offers a considerable economic advantage for the user whilst the different insulating plates are thus protected by the lid 35 against external shocks.

Moreover, re-erection of the box 3 is readily carried out by means of a series of operations in the reverse order to that described in the foregoing.

Figure 6:
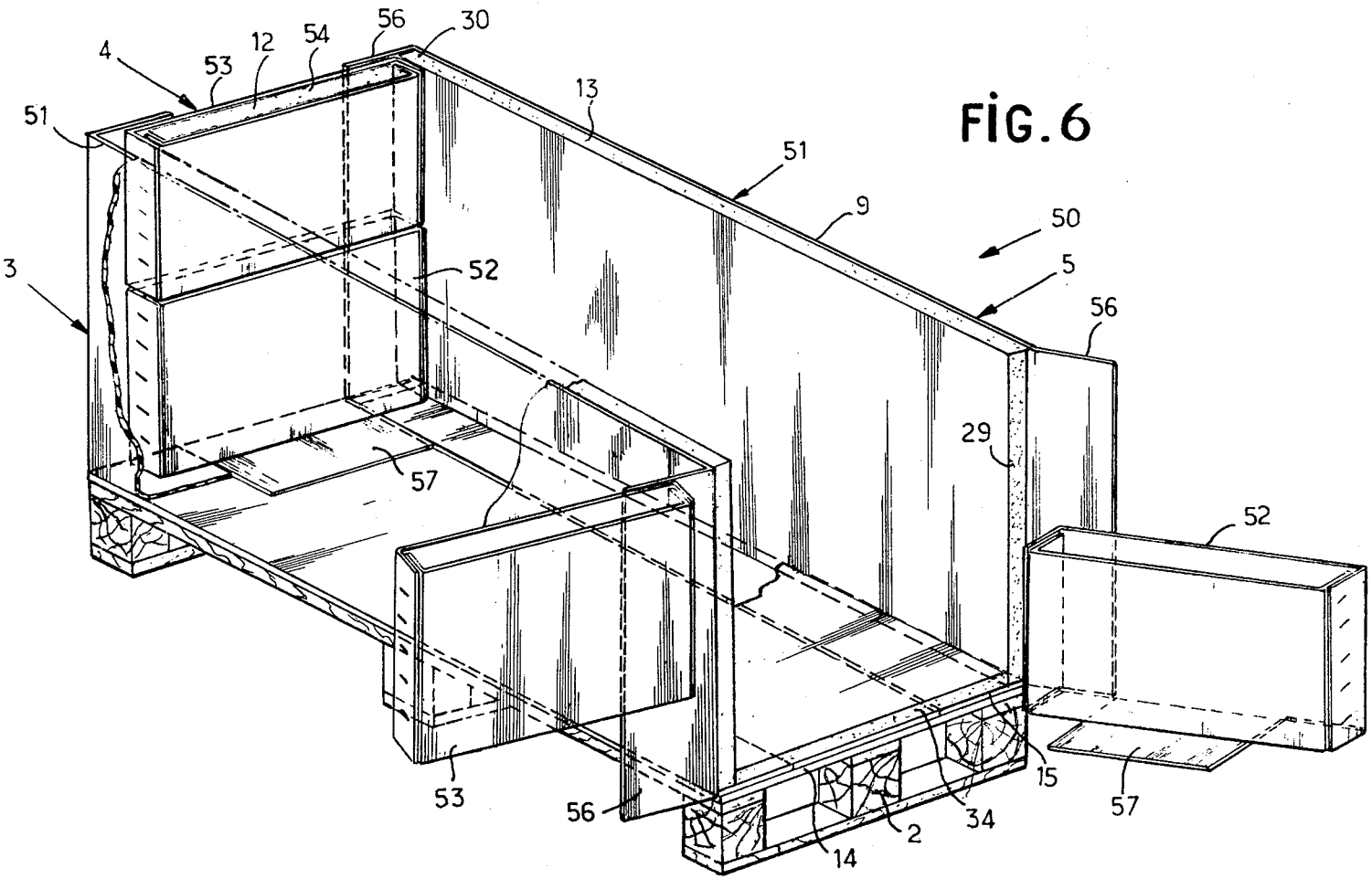
FIG. 6 is a cutaway view in perspective showing a second embodiment of the invention in the erect position.

There is shown in FIG. 6 a container 50 in accordance with a second embodiment of the invention in which provision is made for two panels 51 each provided around the central portion 9 constituting one face 5 in the erect position with a lower side flap 52 and an upper side flap 53.

Each flap 52 or 53 has an extension of slightly smaller width than the end elements 4 of the box 3. Said extension is essentially constituted by a strap added to a tab 56 which forms a lateral extension of the central portion 9.

The flaps 52 and 53 which form part of two different panels 51 are substantially juxtaposed and located in the line of extension of each other when the box 3 is erected so as to ensure that each flap constitutes substantially one-half of one of the end elements 4. The straps constituting said flaps are then placed in the line of extension of each other and define a vertical passage 54 which is occupied by the corresponding insulating end-plate 12. The lower flaps 52 are also provided at the bottom portion in the service position with a projecting portion 57 which is articulated on the outer face thereof and turned back inwards so as to partially close-off the passage constituted by the strap.

In a preferred form of construction of this embodiment, the panels are made of corrugated cardboard, the different assemblies being obtained by stapling and the articulations being obtained by grooving, thus making it possible to adapt the invention to the use of this material.

The invention is not limited to the embodiments which have been described in the foregoing and many other forms of construction can be adopted. In particular, the seating employed may not be a pallet but a different device adapted by way of example to displacement on the rollers which are provided in the holds of freight planes.

The assembly operation is just as easy in all forms of construction and can be carried out in particular by unskilled workers. The sending of containers for loading in situ in underdeveloped countries is therefore possible without any attendant danger of damage. This is particularly useful in the case of food products such as, for example, fish and seafood which are fished and collected locally.

We claim:

1. An insulated container for the storage and transportation of merchandise, comprising a base having two opposite edges secured respectively to two panels, each panel having a central portion located between two side flaps, said two panels being foldable toward said base to constitute two opposite side walls of said container, said side flaps being in turn foldable toward said central portions to constitute the two other opposite side walls of said container, each side flap of each panel overlapping a side flap of the other opposite panel in the erect position of the container, insulation plates disposed against the internal faces of the side walls and the base of the container, said container comprising further a lid fitted with an insulating plate for covering the upper edges of said side walls, one of said two side flaps which is to be overlapped by another side flap comprising an open window adapted to receive a strap arranged on said another side flap so that said strap projects inside the container, the straps of the two opposite side flaps being further adapted to receive within each strap an insulation plate applied against the corresponding overlapped side flap having a window in order to lock the two overlapped side flaps in the erect position of the container by means of the last-named said insulation plate.

2. Insulated container according to claim 1, wherein in the erect position of the container, two opposite edges of said two insulation plates engaged within the straps are applied each against an insulation plate disposed against the central portion of each panel.

3. Insulated container according to claim 1, wherein said two side flaps having an open window comprise each a top flap which is folded over the adjacent insulation plate and inserted partly within the corresponding strap and insulation plate, in the erect position of the container.

4. Insulated container according to claim 1, wherein said two side flaps having an open window comprise each a bottom flap which is inserted within the base of the container and the corresponding insulation plate, in the erect position of the container.

* * * * *